United States Patent [19]

Lee

[11] 4,107,877

[45] Aug. 22, 1978

[54] GARAGE DOOR OPERATOR AND DOOR OBSTRUCTION SENSING APPARATUS

[75] Inventor: Maw Huei Lee, Cincinnati, Ohio

[73] Assignee: Clopay Corporation, Cincinnati, Ohio

[21] Appl. No.: 834,410

[22] Filed: Sep. 19, 1977

[51] Int. Cl.[2] ..... E05F 15/10

[52] U.S. Cl. ..... 49/28; 49/139; 49/199; 49/362; 192/67 P; 192/108; 192/141; 192/143; 192/150

[58] Field of Search ..... 49/28, 31, 199, 362, 49/139, 26; 192/61 P, 108, 141, 143, 150

[56] References Cited

U.S. PATENT DOCUMENTS

| | | | |
|---|---|---|---|
| 2,751,219 | 6/1956 | Dodge | 49/28 X |
| 3,204,170 | 8/1965 | Monks | 49/28 X |
| 3,220,718 | 11/1965 | Wikkerink | 49/139 X |
| 3,858,452 | 1/1975 | Gatland et al. | 49/199 X |
| 3,996,697 | 12/1976 | Bailey et al. | 49/28 |
| 4,018,005 | 4/1977 | Harris | 49/199 |

*Primary Examiner*—Philip C. Kannan
*Attorney, Agent, or Firm*—Wood, Herron & Evans

[57] ABSTRACT

A garage door operator includes a drive screw, rotationally and longitudinally movable in a shuttle track or guide rail, and a screw-driven shuttle mounted on the track and connected to the door. A lever arm is attached to the screw at a rearward end thereof and is pivoted to the operator at one side of the screw. Another end of the lever arm, adjacent an opposite side of the screw, is operatively disposed with respect to control switches and is spring-loaded, whereby door engaged obstructions cause the rotating screw to move longitudinally, against the spring bias, and to actuate, through the lever arm, a switch for stopping or for reversing the operator motor. A sleeve coupling permits longitudinal screw movement with respect to the operator's motor, and is provided with means to permit continued motor operation, drivingly disengaged from the screw, upon control malfunction, in order to prevent damage or injury.

35 Claims, 9 Drawing Figures

GARAGE DOOR OPERATOR AND DOOR OBSTRUCTION SENSING APPARATUS

This invention relates to garage door operators and more particularly to screw-drive garage door operators and improved door obstruction sensing means for mechanically sensing an obstruction, at least during closing movement of the door, through longitudinal movement of the screw.

In a typical screw-driven garage door operator, the operator includes a motor connected to rotate a screw mounted in conjunction with an elongated shuttle track, or guide rail. A shuttle is connected to the screw and is driven along the track when the screw is rotated. A bracket connects the shuttle to the garage door so that rotation of the screw draws the shuttle along the track in a direction away from the door, thereby opening it, or pushes the shuttle along the track in a direction toward the door, thereby closing it.

Considerations of safety require such door operators to be sensitive to obstructions to movement of the door, particularly when closing and, in some cases, when opening. If the closing door should engage a person or some other obstruction, it is desirable to stop the door, or to reverse it. To protect the operator motor, the operator should also be sensitive to obstructions engaged during door opening so that the motor can be stopped before it is damaged.

In a typical overhead door installation, the door is raised for opening and lowered for closing. As the screw is rotated for closing the door, the shuttle is driven along the track toward the door to push it into closed position. The inertia of the door and its mounting mechanism tend to exert, through the shuttle, a rearward force, on the screw in a direction opposite to that in which the shuttle is driven.

On the other hand, when the screw is rotated for opening the door, the shuttle is driven away from the door to pull it open. Again, the inertia of the door and its mounting mechanism exert, through the shuttle, a force on the screw in a direction opposite to that in which the shuttle is driven. Thus, respective opening or closing of the door normally exerts, through the shuttle, respectively opposite longitudinal forces on the motor-driven screw.

Just as these forces move the screw longitudinally, so do further forces exerted on the door, such as, for example, an obstruction engaged by the door. Thus, while it is possible to monitor screw movement in response to forces thereon, it is necessary to differentiate between normal door inertia forces and obstruction-caused forces.

Accordingly, it has been one objective of the invention to provide improved means for sensing a door obstruction.

It has been a further objective of this invention to provide a screw-drive garage door operator having improved means for mechanically sensing longitudinal movement of the screw and differentiating between such movement caused by normal door inertia during operation and by the door engaging an obstruction.

Various forms of electrical switching and control apparatus have been used for controlling the motor of a screw-drive garage door operator to stop the door when it reaches its open or closed limits, or to stop or reverse the door when it engages an obstruction during movement between these limits. Should such electrical switching or other control apparatus fail, however, it is possible that the motor would continue to run against the load imposed by the stopped door and burn out, or otherwise damage the operator motor, or injure or damage the person or thing obstructing the door. Apparatus preventing motor overload in the event of control failure also promotes safety and long operator life.

Accordingly, it has been a further objective of this invention to provide a garage door operator with improved apparatus for preventing motor overloading.

To these ends, a preferred embodiment of the invention includes a screw-driven garage door operator including a longitudinally movable screw and improved biased lever means pivoted to the operator and connected to the screw for sensing longitudinal screw movement for actuating a control switch, in response to the door's engagement with an obstruction, to stop or reverse movement of the door. The screw is coupled to the operator's motor drive shaft, in axial alignment therewith, through a sleeve coupling which accommodates limited longitudinal movement of the screw with respect to the drive shaft, and which operates to disconnect the motor from driving relationship with the screw under predetermined circumstances to avoid motor overload and to prevent damage or injury.

The lever means in preferred form is bifurcated to form a yoke having legs pivoted adjacent a first side of the screw, the yoke being joined on a second opposite side of the screw to form a one-piece lever end. The yoke legs are attached to the operator on third and fourth opposite sides of the screw, through a bearing in which the screw is mounted. The one-piece lever end has a depending switch actuating arm extending between two control switches for actuating them respectively in response to a predetermined movement of the screw and respective pivoting of the lever.

One end of the switch actuating arm is captured in slots in two opposed spring-loaded brackets, the springs being independently adjustable to bias the lever, and the screw, to a neutral or central position during normal operation, and to permit longitudinal screw movement, and resulting lever actuation of a switch, in response to door engagement with an obstruction which exerts more force on the screw than normal door inertia.

The operator motor drive shaft/screw coupling is fixed on the screw and is slidably disposed over the drive shaft. An elongated slot in the sleeve receives a crosspin on the drive shaft. Thus, the sleeve can reciprocate on the drive shaft while being driven thereby. Two annular grooves within the interior wall of the sleeve coupling and in a plane transverse to the plane of the elongated slot communicate with the slot at its respective ends to accommodate the drive shaft crosspin and permit free rotation of the drive shaft, without rotation of the screw, when the screw and sleeve coupling are moved longitudinally over a predetermined distance. Such movement is caused by virtue of the door's engagement with an obstacle or by its engagement with a limit stop at a time when the normal obstruction sensing or stopping control fails and the motor continues to operate. This prevents motor overload and injury or damage in the event of control failure.

Through the mechanical advantage provided by the lever means of the preferred embodiment, relatively small springs can be used to bias the screw against such longitudinal movement as would cause switch actuation. Yet, these springs are adjusted to permit greater screw movement, and resulting switch actuation, in the presence of an obstruction to door operation, where the forces exerted on the screw by the shuttle are greater than the forces exerted on the screw by the shuttle by virtue of normal door inertia.

In addition, in the event of control failure wherein the motor continues to operate when an obstruction is present or when the door reaches an open or closed limit stop, the screw moves longitudinally until the drive shaft pin enters one of the annular grooves, whereupon the motor is free to rotate and the screw is not positively driven. When the obstruction is removed or the operator is re-started, the stressed spring biases the lever and screw toward a centered neutral position whereupon the pin re-engages the slot upon registering therewith and normal operation is continued. Motor overload is thereby prevented.

The above and other objectives and advantages will become readily apparent from the following detailed description of a preferred embodiment of the invention and from the drawings in which.

Figure 1:
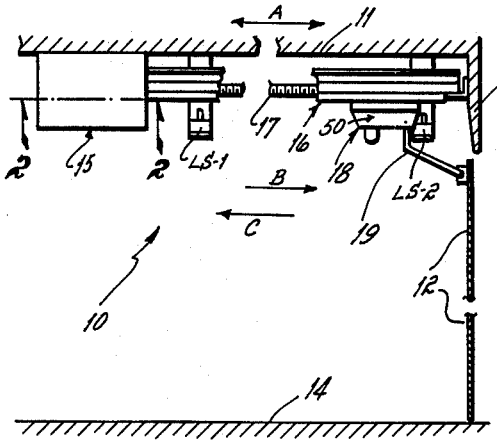
FIG. 1 is an elevational view of a screw-drive garage door operator according to the invention.

Turning now to the drawings, FIG. 1 thereof shows a screw-drive garage door operator 10 according to the invention. The operator 10 is shown in a typical environment wherein it is attached to a ceiling 11 in position to operate a door 12 between a closed position, as shown in FIG. 1 wherein the door 12 covers the opening between the header 13 and the floor 14 of a typical garage, and an open position (not shown) wherein the door is drawn upwardly and rearwardly to an overhead position wherein the door is held generally parallel to the floor 14. The door is mounted at each side by rollers extending into door rails which parallel the door in both its open and closed position, as is well known. The door mounting apparatus forms no part of the present invention.

The operator 10 includes a motor housing 15, an elongated shuttle guide rail or track 16, a screw 17, a shuttle 18 and a bracket 19 for attaching the shuttle 18 to the door 12.

The Track

Figure 6:
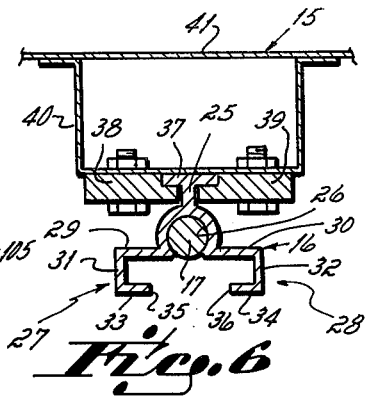
FIG. 6 is a cross-sectional view taken along line 6—6 of FIG. 2.
Figure 8:
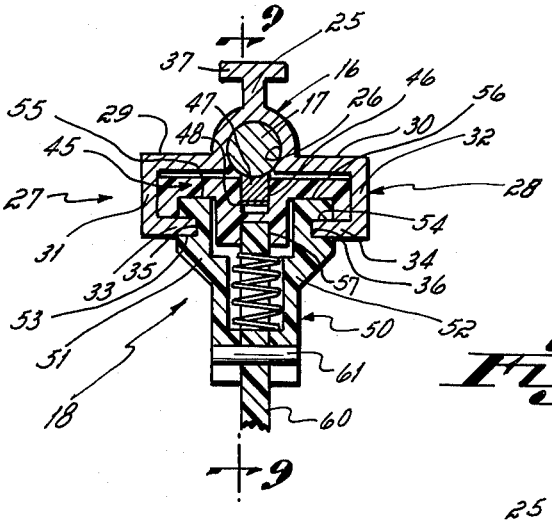
FIG. 8 is a cross-sectional view taken along line 8—8 of FIG. 7.

While the invention described in this application may be utilized with various types of screw-drive garage door operators, wherein the screw can be mounted for longitudinal movement thereof, the guide rail or track 16 of the preferred embodiment of the invention as shown in FIG. 1 is particularly shown in FIGS. 6 and 8. The elongated track 16 includes a guide rail section 25 as seen in FIGS. 6 and 8. The track 16 further comprises an arcuate screw channel 26 in which the screw 17 is disposed for both rotational and longitudinal movement with respect to the track 16. At the lower edges of the screw channel 26, the track 16 further includes opposed, integral, U-shaped channels 27 and 28 comprising upper flanges 29 and 30, depending vertical legs 31 and 32, and lower flanges 33 and 34. The lower flanges 33 and 34 have respective ends 35 and 36 defining a slot therebetween along the lower portion of the track 16. As shown in FIG. 6, the upper cross-section of the elongated track 16 is T-shaped so that an upper flange 37 of the track 16 may be secured to the operator by means of hold-down dogs 38 and 39 bolted to a bracket 40 attached to a plate 41 of the operator housing 15.

The Shuttle

Further, and by general way of illustrative description, the shuttle 18 may be a one-piece shuttle apparatus slidably mounted on the elongated track 16 in operative connection with screw 17 so that as the screw is rotated, the shuttle 18 is driven back and forth along the track 16. Limit switches LS-1 and LS-2 are mounted on the track 16 in position to be engaged by the shuttle 18 when it reaches a position corresponding to the door open position (LS-1) and the door closed position (LS-2). The limit switches are connected through appropriate circuitry and control apparatus, not forming part of this invention, for stopping the operator when the door is fully opened or closed.

In some instances, it is desirable to disconnect the door 12 from the operator 10. This can be accomplished by disconnecting the bracket 19 from the door 12 or from the shuttle 18, for example, or it can be accomplished by disconnecting the shuttle 18 from operative engagement with the screw 17. Thus, in the case where the bracket 19 is simply to be disconnected from either the door 12 or the shuttle 18, a one-piece shuttle 18 could be utilized.

Figure 7:
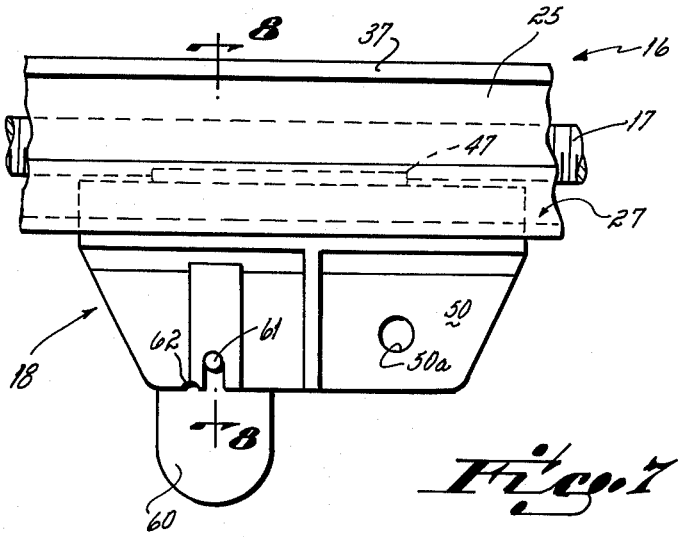
FIG. 7 is an elevational view of a shuttle and guide rail.
Figure 9:
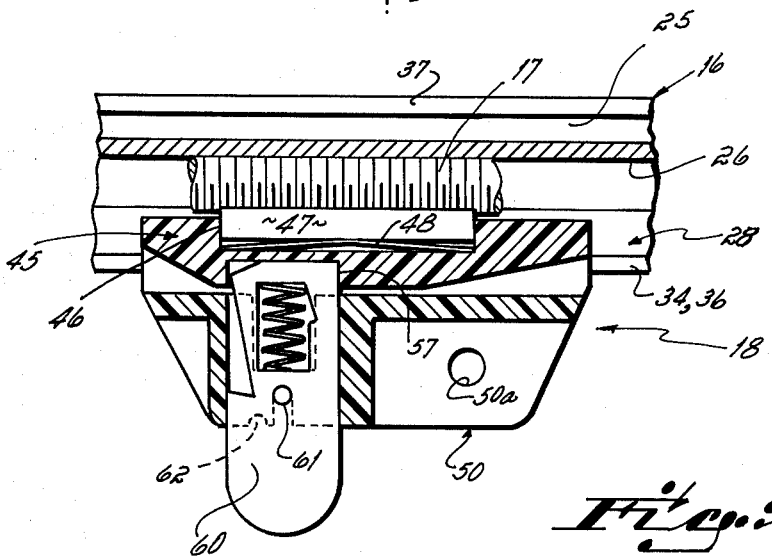
FIG. 9 is a cross-sectional view taken along line 9—9 of FIG. 8.

On the other hand, it may be desirable to utilize a two-piece shuttle such as that shown by way of illustration in FIGS. 7–9. In the drawings, and particularly at FIGS. 7 through 9, a two-piece shuttle 18 comprises a screw-driven traveler 45 disposed within the U-shaped channels 27 and 28. The screw-driven traveler 45 incorporates a first recess 46 and a quarter nut 47 therein. The nut 47 is engageable with the screw 17 as shown in FIGS. 8 and 9 and is urged toward operative engagement with the screw 17 by means of the leaf spring 48. Thus, as the screw 17 rotates, the screw-driven traveler 45 is driven within the U-shaped channels 27 and 28 of the track 16 by virtue of engagement of the quarter nut 47 with the screw 17. Direction of travel of the screw-driven traveler 45 is parallel to a longitudinal axis of the screw 17 in the reciprocal directions indicated by the double arrow A in FIG. 1.

The two-piece shuttle 18 also includes a coupling traveler 50 to which bracket 19 is connected via aperture 50a in the coupling traveler 50. The coupling traveler 50 has upstanding legs 51 and 52, each provided with a slot respectively at 53 and 54 in which are received the inwardly turned ends 35 and 36 of the lower legs 33 and 34, respectively, of the U-shaped channels 27 and 28. Thus, the coupling traveler 50 is slidably mounted on the lower legs of the U-shaped channels of the elongated track 16.

As shown in FIG. 8, the screw-driven traveler 45 is provided with longitudinal grooves 55 and 56 which receive the upper ends of the legs 51 and 52 of the coupling traveler 50. Thus, it can be appreciated from FIG. 8 that the screw-driven traveler 45 and the coupling traveler 50 are free to slide along track 16 in non-interfering relationship. When the screw-driven traveler 45 and the coupling traveler 50 are disposed at the same point along the track, the upstanding legs 51 and 52 of the coupling traveler 50 simply slide within the grooves 55 and 56 of the screw-driven traveler 45.

In order to operatively connect the coupling traveler 50 to the screw so that the door 12 may be opened and closed, a spring-loaded latch 60 is mounted within the coupling traveler 50. In FIG. 9, the latch 60 is shown in raised, or coupled, position thereby coupling the coupling traveler 50 with the screw-driven traveler 45 via a second recess 57 within the screw-driven traveler 45. As can be seen in FIG. 9, when it is desired to release the coupling traveler 50 from the screw, the latch 60 is pulled downwardly and rearwardly so that the retention pin 61 is rotated to reside within the detent 62. This retraction and pivoting of the latch 60 disengages the coupling traveler 50 from the screw-driven traveler 45 and permits the door to be raised or lowered independently of the screw 17 and the screw-driven traveler 45. In this mode of operation, the coupling traveler 50 continues to slide along the track 17 as the door is raised and lowered.

It should be appreciated that the foregoing description of the two-piece shuttle 18 is simply for illustrative purposes only and that any type of screw-driven traveler which is operable to connect the screw to the door for operation of the door could be utilized. While not believed to be necessary to this application, and by way of further illustration only, further details of the two-piece traveler as described may be found in a co-pending patent application entitled "Improved Traveler Apparatus for Screw-Drive Closure Operator", filed on even date herewith, and assigned to the same assignee as this application by named inventors Maw H. Lee and Barry V. Prehodka.

Sleeve Coupling

Figure 2:
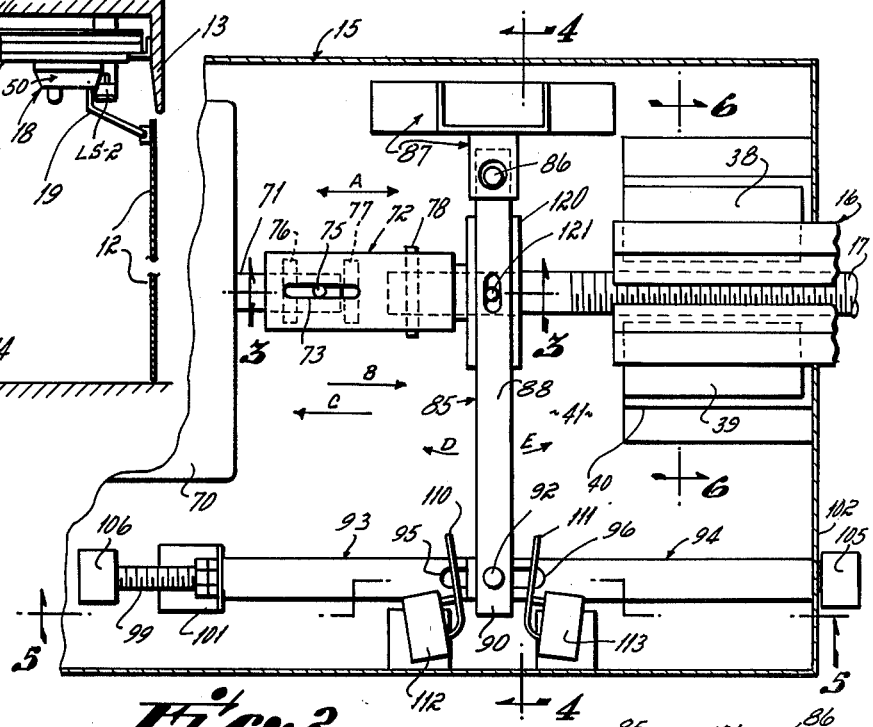
FIG. 2 is a bottom cutaway view taken along line 2—2 of FIG. 1.
Figure 3:
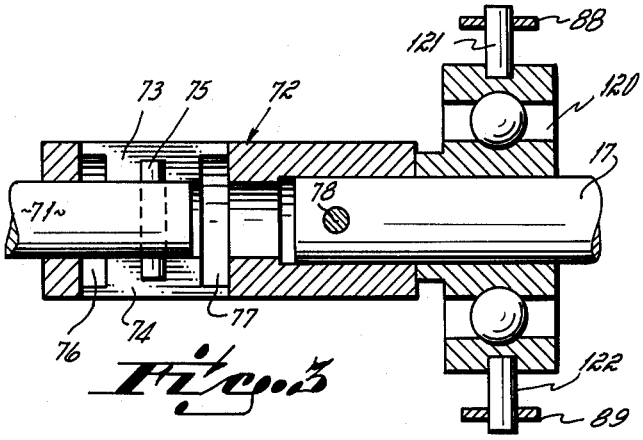
FIG. 3 is a cross-sectional view taken along line 3—3 of FIG. 2.

Turning to FIGS. 2 through 6, the obstruction sensing apparatus of the present invention will now be described. Within the motor housing 15, as shown in FIG. 2, is mounted a motor 70. The motor 70 has an output drive shaft 71, as shown in FIG. 3, which is connected through a sleeve coupling 72 to the screw 17. The sleeve coupling 72 is connected to the motor 70 for rotation thereby and to permit longitudinal movement of the screw in reciprocal directions (arrow A, FIG. 2) parallel to the longitudinal axis of the screw. To this end, the sleeve coupling 72 is preferably constructed as shown in FIGS. 2 and 3, and includes elongated slots 73 and 74 on opposite sides of the sleeve coupling 72. These slots accommodate a crosspin 75 fixed transversely within the drive shaft 71. As the drive shaft 71 rotates, the crosspin 75 engages the sides of the slots 73 and 74 and rotates the sleeve coupling 72. Since the slots 73 and 74 are elongated, however, it will be noted that the sleeve coupling 72 (and thus the screw 17) may move longitudinally with respect to the pin 75 and the drive shaft 71.

Annular grooves 76 and 77, respectively, are provided within interior walls of sleeve 72 at each end of the slots 73 and 74. These annular grooves are disposed in planes which are transverse to the plane of slots 73 and 74. The depths of the grooves 76 and 77 are such as to accommodate the pin 75. Thus, should the sleeve 72 move longitudinally with respect to the drive shaft 71 a sufficient distance so that pin 75 resides within either one of the annular grooves 76 or 77, the pin 75 would be free to rotate within the annular groove and would thus be out of positive driving engagement with the coupling 72.

At the other end of the sleeve 72 the screw shaft 17, in a preferably non-threaded portion thereof, is positively coupled within the sleeve 72 by means of a pin 78. Thus, when the drive shaft 71 is rotated and the pin 75 resides in the slots 73 and 74, the sleeve coupling 72 is rotated to rotate the screw shaft 17.

At the forward end of the operator 10, the screw 17 is mounted within the track 16 and more particularly within the arcuate screw channel 26. The elongated track 16 is mounted to the operator via the hold-down dogs 38 and 39 as have been described in connection with FIG. 6. The tolerance between the screw 17 and the interior walls of the screw channel 26 permit rotation of the screw with respect to the track and longitudinal movement of the screw in reciprocal directions parallel to the longitudinal axis of the screw (arrow A).

In order to further understand the operation of the obstruction sensing apparatus of the present invention, it should be appreciated that, as the motor 70 is energized to rotate the shaft 71 and thus the screw 17 in order to close the door, the shuttle 18 is moved in a direction indicated by the arrow B, FIGS. 1 and 2. Should the door 12, however, engage an obstruction during its closing motion, that is, as it moves toward the floor 14, the door will be stopped, and this obstructing force will be transmitted through the door 12, the bracket 19, and the shuttle 18 to the screw 17. As the motor continues to drive the screw 17, the screw 17 will move rearwardly, that is, in the direction of arrow C as shown in FIGS. 1 and 2.

On the other hand, when the operator is operating to open the door 12, the shuttle 18 is driven in the direction of arrow C. Should the door engage an obstruction as it moves upwardly, this force is also transmitted through the door 12, the bracket 19, and the shuttle 18 to the screw 17. In this fashion, when the shuttle 18 is stopped as by an obstruction engaging the door, the screw continues to rotate and tends to move in a longitudinal direction indicated by the arrow B in FIGS. 1 and 2. If during either one of these operations the operator continues to operate so as to rotate the screw 17, the screw 17 will rotate until it is moved sufficiently forwardly or rearwardly so that the coupling sleeve 72 moves longitudinally with respect to the pin 75 and eventually the pin 75 falls into a respective annular groove 76 or 77, whereby the drive shaft 71 of the motor 70 can rotate freely without further positively driving the screw 17. This prevents overload in an extreme condition where the door is obstructed, or stopped at its open or closed limits, and for some reason the operator control is not operated to stop or to reverse the motor.

For example, in the operator of the preferred embodiment, limit switches LS-1 and LS-2 are mounted on the track 16 in a position to be engaged by the shuttle 18 when the door is fully opened (LS-1) or closed (LS-2). When the limit switch LS-1 is engaged, that indicates that the door is fully opened and the operator is normally stopped. When the operator is re-actuated to close the door, the door moves toward its closed position as shown in FIG. 1 wherein the shuttle 18 engages the limit switch LS-2 thereby normally controlling the operator to stop.

Should LS-1 or LS-2 fail, or its associated control circuitry fail, the operator motor 70 may continue to rotate, and this would have the effect of driving the operator motor until the screw was moved sufficiently forwardly or rearwardly, respectively, for the pin 75 to fall within the groove 76 or 77 and permit continued operation of the motor. This prevents burnout or other damage or injury until such time as the operator motor can be otherwise stopped and the malfunction repaired.

Obstruction Sensing Apparatus

In order to sense obstructions engaged by the door, a preferred embodiment of the present invention further includes a lever arm 85 pivoted to the operator housing 15 on a pivot axis defined by pin 86. The pin 86 is mounted to the operator via a bracket 87 extending from the housing plate 41.

Figure 4:
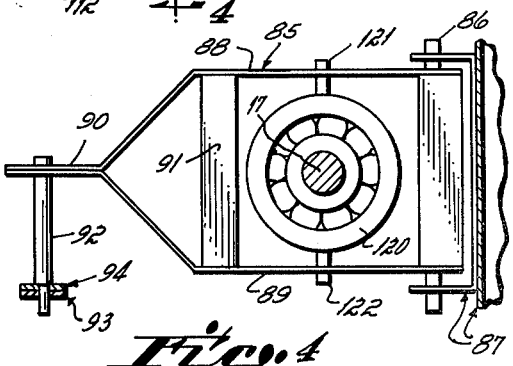
FIG. 4 is a cross-sectional view taken along line 4—4 of FIG. 2.

The lever arm 85 is bifurcated to form a yoke portion having legs 88 and 89 as best seen in FIG. 4. Each leg 88 and 89 is pivoted on the pivot axis 86 adjacent a first side of the screw as shown in FIG. 4, and the legs 88 and 89 are joined at 90 adjacent an opposite or second side of the screw 17 to form a one-piece lever end. A reinforcing member 91 is preferably disposed between the two legs 88 and 89 for reinforcement purposes. The joined portion 90 of the lever arm 85 supports a switch actuating arm 92 which depends from the lever arm 85 as shown in FIG. 4.

Figure 5:
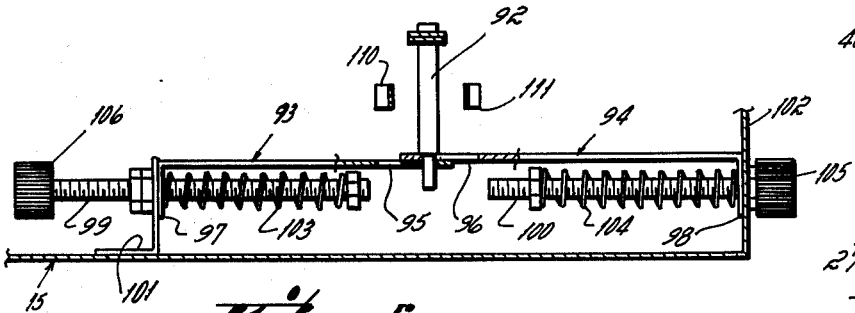
FIG. 5 is a cross-sectional view taken along line 5—5 of FIG. 2.

As best seen in FIG. 5, the lower end of the switch actuating arm 92 is disposed within two respective brackets 93 and 94. Each of the brackets 93 and 94 has a respective slot 95 and 96 therein in which the lower end of the switch actuating arm 92 resides. As best seen in FIGS. 2 and 5, the brackets 93 and 94 are disposed on opposite sides of the switch actuating arm 92. Each bracket 93 and 94 has a depending leg 97 and 98 through which a respective bolt 99 and 100 extends. The bolt 99 is mounted via a respective bracket 101 to a plate portion of the operator housing 15 as shown in FIG. 5. The bolt 100 is mounted in a housing portion 102 of the operator housing 15. Respective springs 103 and 104 are captured between the respective legs 97 and 98 of each bracket 93 and 94 and a nut on the end of the respective bolts 99 and 100. Thus, as shown in FIGS. 2 and 5, the brackets 93 and 94 exert opposing spring-loaded forces on the switch arm 92.

As also shown in FIGS. 2 and 5, the switch actuating arm 92 extends between the trip arms 110 and 111 of control switches 112 and 113, mounted within the operator housing 15. The trip arms 110 and 111 are disposed in an operative position so as to be actuated by the switch actuating arm 92 upon movement of the lever arm 85 to such a predetermined extent as would cause the actuating switch arm 92 to engage the switch arm 110 or 111.

In order to drive the lever arm 85, the bifurcated yoke portion is connected to the screw 17 through a bearing 120 in which screw 17 is mounted. The bearing 120 is provided with pins 121 and 122 which extend outwardly into slots in the respective legs 88 and 89 of the lever arm 85 on respective third and fourth opposite sides of the screw 17. Thus, it can be appreciated that as the screw is moved longitudinally, this movement causes the lever arm 85 to pivot in an arcuate direction, D or E respectively, depending upon movement of the screw. As the screw 17 is moved rearwardly, toward the motor 70, the lever arm 85 is swung about pivot pin 86 in a direction indicated by arrow D, FIG. 2. If the screw 17 is moved forwardly, and away from the motor 70, the lever arm 85 is swung in an arcuate direction indicated by arrow E, FIG. 2.

Operation

The operation of the present invention will now be described. It will be appreciated from the foregoing description that the lever arm 85 is spring-loaded against movement in either direction D or E by virtue of the springs 103 and 104 and brackets 93 and 94 acting in cooperation with the switch actuating arm 92. During ordinary opening or closing motion of the door 12, the springs 103 and 104 maintain sufficient bias on the lever arm 85, and thus, on the screw 17, through the bearing 120, to maintain the screw 17 in a neutral or normal position such that the switch actuating arm 92 is disposed between the trip arms 110 and 111. In the case where the screw 17 is being rotated in order to drive the shuttle 18 forwardly to close the door 12, the normal forces exerted by the inertia of the door 12 and its mounting mechanism tend to drive the screw 17 rearwardly. The spring 104, however, is sufficiently adjusted, via rotation of the knob 105 and connected bolt 100 such that the screw 17 and lever arm 85 do not move rearwardly sufficiently in the direction indicated by the arrow D to cause the switch actuating arm 92 to engage the trip arm 110 of the switch 112. Thus, normal closing operation continues.

Should the door engage an obstruction, however, the additional force exerted through the door 12, the bracket 19, and the shuttle 18 would cause the screw 17, upon continued rotation, to be moved rearwardly a predetermined distance, associated with obstruction engaging, and overcoming the bias of the spring 104. When the screw 17 moves this predetermined distance rearwardly, the lever arm 85 is pivoted in the direction D, and the switch actuating arm 92 engages the trip arm 110 to actuate the switch 112. Of course, this predetermined distance through which the screw moves is less than that distance of movement necessary to move the pin 75 into annular groove 77 of the sleeve coupling. Thus, in normal operation, the screw is not drivingly uncoupled from the drive shaft 71. The switch 112 is connected through any suitable and appropriate circuitry and control apparatus, not forming part of this invention, for operating the motor 70. Actuation of the switch 112 can be utilized to either stop the motor 70, or to reverse it, thereby immediately stopping or raising the door 12. Any form of control circuitry can be utilized to control the operator, the control circuitry of the operator forming no part of the present invention.

In the case where the operator is operated to open the door 12, the normal inertia and the door and its mounting mechanism tends to exert, via the bracket 19 and the shuttle 18, a force on the screw 17 tending to move the screw in a forward direction, indicated by the arrow B. The spring 103, however, is adjusted via knob 106 and connected bolt 99 so that the normal forces exerted by the door 12 during its opening movement are not sufficient to move the screw 17 against the bias of the spring 103.

Should the door 12 encounter an obstruction, however, as it moves upwardly, the additional force placed on the screw 17 via the door 12, the bracket 19, and the shuttle 18 cause the screw 17 to move in a forward direction, as indicated by arrow B, a predetermined distance, overcoming the bias of the spring 103. At this point, the switch arm 85 is rotated about the pivot axis or pin 86 in the direction of arrow E and the switch actuating arm 92 engages the trip arm 111 to actuate the switch 113. The predetermined movement of the screw in the forward direction is less than that required for the pin 75 on drive shaft 71 to fall into groove 76 of the sleeve coupling. Thus in normal operation, the screw is not drivingly uncoupled from the drive shaft 71. The switch 113 is also connected through suitable and appropriate circuitry and control apparatus, not forming part of this invention, whereby the movement of the door can be stopped or otherwise controlled as desired.

It will be appreciated, of course, that the inertia of the door and the door mounting mechanism varies during operation. For example, the inertia of the system is generally greater when the door is at a standstill in a closed position than it is as the door is moving upwardly. The spring 104 is thus adjusted via the knob 105 and bolt 100 so that even the starting inertia of the door is not enough to overcome the spring bias and actuate the switch 112. Likewise, the starting inertia of the door in an open position is generally greater than it is during continued operation of the door to a closed position. The spring 103 is adjusted, via knob 106 and bolt 99, so that even the starting inertia of the door from an open to a closed position is not sufficient to cause actuation of the switch 113.

Accordingly, the invention differentiates between the threshold load or forces exerted by normal door inertias and those exerted by obstructions, and senses the obstructions to actuate control switches.

It will also be appreciated that the override feature provided by the sleeve coupling 72 is also operable to prevent injury or damage should the switches LS-1, LS-2 112 or 113 or their associated control circuitry fail. Accordingly, if the door hits an obstruction during operation thereof, and the switches 112 and 113 do not operate in the preferred mode as described, continued operation of the motor 70 rotates the screw 17 which is moved either forwardly or rearwardly sufficiently to cause the sleeve 72 to move with respect to the crosspin 75 so that the crosspin 75 falls within the annular groove 76 or 77, respectively, whereby the motor 70 may continue to rotate without positively driving the screw. The motor thus is relieved from the overload presented by the obstruction until such time as the operator can otherwise be shut down and the obstruction cleared.

Once the obstruction is removed, the springs 103 and 104 tend to center the switch actuating arm 92, the lever 85, and thus the screw 17. The bias provided by the springs 103 or 104 tends to move the sleeve 72 rearwardly or forwardly, respectively, and this bias will permit the slots 73 and 74 to re-engage the crosspin 75 upon re-start of the motor 70 and rotation of the drive shaft 71, thereby re-engaging the operator for continued operation.

It will thus be appreciated that the lever arm 85 provides sufficient mechanical advantage to control the screw 17 in the manner desired as described above. The spring-loaded apparatus as described is mounted on the operator in such an accessible position that the springs 103 and 104 can be easily adjusted via the knobs 105 and 106, without having to disassemble the operator. The bifurcated lever arm 85 provides a positive lever attachment to the screw 17 for even the extreme longitudinal positions thereof. The pivoting of the lever arm 85 adjacent one side of the screw 17, combined with the operational features of the switch actuating arm 92 and the spring-loaded brackets 93 and 94 adjacent another side of the screw, facilitate operation and adjustment of the apparatus throughout its various modes of operation.

Finally, it should also be appreciated that while a preferred sleeve coupling 72 has been particularly described, it is also possible to reverse the coupling, fixing it to the drive shaft 71 and providing for longitudinal movement between the coupling and the screw shaft and its pin 78 to accomplish the purposes hereinabove described.

These and other advantages and modifications will become readily apparent to one of ordinary skill in the art without departing from the scope of the invention and the applicant intends to be bound only the claims appended hereto.

I claim:

1. In a screw-driven garage door operator having a motor for rotating a screw and an operator control means for controlling said operator to selectively raise and lower a door, improved means for sensing a door obstruction and for controlling said operator in response to sensing said obstruction including:

a screw in said operator, said screw connected to said door for raising and lowering said door upon rotation of said screw, and said screw being movable in a longitudinal direction parallel to a longitudinal axis of said screw, whereby when said door strikes an obstacle, said screw, upon continued rotation, is moved in said longitudinal direction at least a predetermined distance, at least one control switch operatively connected to said operator control means, and control switch actuating means comprising a lever arm pivoted at one end to said operator on one side of said longitudinal axis, said lever arm connected intermediate its ends to said screw, and said lever arm having another end disposed in cooperative relationship with said control switch for actuating said control switch when said screw moves in said longitudinal direction over said predetermined distance.

2. Apparatus as in claim 1 further including means connecting one end of said screw to a drive shaft on said motor, in axial alignment therewith, for rotating said screw and for accommodating longitudinal movement of said screw during rotation thereof.

3. Apparatus as in claim 2 wherein said screw is mounted to move in a longitudinal direction away from said motor in response to interference with the movement of said door from a closed to an open position, and wherein said screw is mounted to move toward said motor, in an opposite longitudinal direction, in response to interference with movement of said door from an open to a closed position.

4. Apparatus as in claim 2 wherein said screw is reciprocally mounted for movement in opposite directions parallel to said longitudinal axis, and including two control switches disposed in operative relationship with said other end of said lever arm, one of which said switches being operatively connected to said operator control means for stopping said motor when said one switch is actuated in response to longitudinal movement of said screw in one direction, and a second of which said switches being operatively connected to said operator control means for reversing said motor when said switch is actuated in response to longitudinal movement of said screw in an opposite direction.

5. Apparatus as in claim 2 wherein said screw is movable in opposite longitudinal directions and further including two control switches operatively connected to said operator control means and being disposed in cooperative relationship with said other end of said lever arm.

6. Apparatus as in claim 5 wherein the pivoted end of said lever arm is bifurcated, each separate bifurcated portion of said lever arm extending past respective opposite sides of said screw and being connected thereto.

7. Apparatus as in claim 6 wherein said other end of said lever arm is spring-loaded and yieldably biased to a central position out of actuating engagement with either of said switches.

8. Apparatus as in claim 7 further including opposed brackets connected to said other end of said lever arm and opposed springs operatively connected to said brackets for yieldably biasing said lever arm toward said central position.

9. Apparatus as in claim 8 wherein the bias of said respective opposed springs is greater than a predetermined threshold load below which said springs operate to keep said lever arm from engaging either control switch.

10. Apparatus as in claim 2 wherein said connecting means comprises:

a sleeve, a motor drive shaft, one of said screw and said shaft being connected to said sleeve, pin means on at least one of said screw and said drive shaft, and at least one longitudinal slot in a wall of said sleeve, said pin means engaged in said slot to drivingly engage said sleeve and said slot accommodating movement of said pin means in a direction parallel to the longitudinal axis of said screw to permit longitudinal movement of said screw with respect to said drive shaft.

11. Apparatus as in claim 10 further including an annular groove in an inner wall of said sleeve, transverse to said slot said slot operatively connected to said annular groove, and said pin moving relatively through said slot and into said annular groove upon relative movement of said screw with respect to said drive shaft, greater than said predetermined distance, the depth of said annular groove being greater than the extension of said pin, said pin and sleeve moving with respect to each other, out of positive driving relationship, in response to said relative movement of said screw and said drive shaft greater than said predetermined distance.

12. Apparatus as in claim 11 including two annular grooves in an inner wall of said sleeve, said slot operatively communicating with each annular groove at respective ends of said slot, said pin moving into one of said annular grooves, corresponding to relative movement of said screw with respect to said drive shaft greater than said predetermined distance, and said pin moving with respect to said sleeve, within said one annular groove, said pin and sleeve being disengaged from positive driving relationship with each other in response to said predetermined relative movement between said screw and said drive shaft.

13. Apparatus as in claim 10 wherein said screw is connected to said sleeve and further including:

pin means extending from said drive shaft, at least one longitudinal slot in said sleeve, said pin means residing in said slot to rotate said sleeve when said drive shaft is rotated by said motor, and said slot accommodating longitudinal movement of said screw and sleeve with respect to said drive shaft.

14. Apparatus as in claim 13 including at least one annular groove within an inner wall of said sleeve, said annular groove transverse to and operatively communicating with said slot and said pin means moving along said slot and into said annular groove in response to predetermined longitudinal movement of said screw greater than said predetermined distance, whereby said pin disengages from said slot and said sleeve is disengaged from positive driving relationship with respect to said pin means and drive shaft.

15. Apparatus as in claim 14 including two annular grooves in an inner wall of said sleeve and transverse to said slot, said slot having two ends, each operatively communicating with a respective one of said annular grooves, said pin means moving through said slot into one of said annular grooves in response to relative predetermined movement of said screw and sleeve with respect to said drive shaft, said pin means and said sleeve disengaging from positive driving relationship when said pin means is in one of said annular grooves.

16. Apparatus as in claim 15 wherein said lever arm and said screw are yieldably biased to a central position and wherein said pin means resides in said longitudinal slot when said lever arm and screw are in said central position.

17. Apparatus as in claim 16 wherein said bias urges said pin means in a direction toward said slot when said pin means is in one of said annular grooves.

18. In a screw-drive garage door operator of the type for raising and lowering a garage door and including a motor for driving an elongated screw and shuttle means for connecting a door to the screw, said garage door operator further including improved load sensing apparatus for selectively actuating an operator control means for controlling the door's movement in response to a load thereon in excess of a predetermined load, said load sensing apparatus comprising:

a drive screw monted for rotation about a longitudinal axis thereof, and for longitudinal movement in at least one direction parallel to the longitudinal axis of said screw, means connecting said screw to a motor for imparting rotational movement to said screw and for accommodating said longitudinal movement, at least one control switch means for controlling said operator, a control switch actuating lever means connected to said screw for pivoting upon longitudinal movement of said screw and for actuating said control switch means upon longitudinal movement of said screw over a predetermined distance, said lever means pivotally mounted to said operator adjacent a first side of said screw and having a switch actuating arm disposed adjacent a second opposite side of said screw in operational alignment with said control switch means, and adjustable spring means for spring-loading said lever means against movement thereof, whereby, when said door engages an obstruction, said door and said shuttle stop and continued rotation of said screw causes said screw to move longitudinally over said predetermined distance, against said spring-loading, causing said lever means to pivot and said actuating lever arm to engage and actuate said control switch means to control said operator.

19. Apparatus as in claim 18 wherein said lever means comprises a lever having a bifurcated portion forming a yoke having two legs, adjacent respective opposite third and fourth sides of said screw, said legs having distal ends pivoted to said operator adjacent said first side of said screw, and said legs joined together adjacent said second side of said screw; and said switch actuating arm depending from said joined-together legs to an operative position adjacent said control switch means.

20. Apparatus as in claim 19 wherein said screw is mounted for reciprocal movement in opposite directions parallel to the longitudinal axis of said screw and further including:

two control switches operatively disposed on opposite sides of said switch actuating arm, said switch actuating arm extending beyond said switches, two brackets, each having slots at one end and said switch actuating arm extending through both said slots, said brackets disposed on opposite sides of said switch actuating arm and each bracket being spring-loaded by said respective spring means to bias said switch actuating arm toward a respective switch, said biases offsetting each other and holding said arm in a neutral position between said switches wherein neither switch is actuated by said switch actuating arm.

21. Apparatus as in claim 20 wherein each spring means is adjustable, independently of the other, whereby the force necessary to move said screw in each direction and to actuate through said lever means and switch actuating arm, a respective switch, is independently predetermined.

22. Apparatus as in claim 19 including a bearing means, said screw mounted for rotation therein, and an outer portion of said bearing being connected to the legs of said yoke adjacent said third and forth sides of said screw, whereby longitudinal movement of said screw pivots said lever means.

23. In a screw-driven garage door operator of the type having a motor for rotating a screw and an operator control means for controlling said operator to selectively open and close said door, improved means for sensing a door obstruction and for signalling said control means in response to sensing said obstruction, said improved sensing means including:

a screw in said operator, said screw connected to said door for opening and closing said door upon rotation of said screw, and said screw being movable in a longitudinal direction parallel to a longitudinal axis of said screw, whereby when said door strikes an object during closing, said screw, upon continued rotation, is moved in said longitudinal direction at least a predetermined distance, a motor in said operator having a drive shaft in axial alignment with said screw, means coupling said drive shaft to said screw for rotating said screw when said motor is operated and for accommodating longitudinal movement of said screw during rotation thereof, at least one control switch operatively connected to said control means, and a control switch actuating lever pivoted adjacent said screw, said lever having a bifurcated portion surrounding and connected to said screw and having a switch actuating portion operatively disposed in relation to said switch for actuating said switch when said screw is moved said predetermined distance in said longitudinal direction.

24. Apparatus as in claim 23 wherein said lever is spring-loaded and is yieldably biased toward a position in which it does not actuate said control switch.

25. Apparatus as in claim 24 wherein said screw is mounted for first and second reciprocal movements in respective directions parallel to said longitudinal screw axis whereby when said door strikes an object during closing or opening said screw, upon continued rotation, said screw is moved in said first or second said direction, respectively.

26. Apparatus as in claim 25 including a second control switch operatively disposed in relation to said lever for actuation by said lever when said screw is moved in said second direction.

27. Apparatus as in claim 26 wherein said lever is spring-loaded in two opposing directions and is biased into a central position, between said control switches, where it does not actuate either control switch.

28. Apparatus as in claim 27 wherein said spring bias is applied through said lever to said screw and biases said screw toward a neutral position in said longitudinal directions, in the absence of said door striking an object during opening or closing, and in which neutral position of said screw said lever arm does not actuate either of said control switches.

29. Apparatus as in claim 28 wherein said spring bias in each of said two directions is adjustable.

30. Apparatus as in claim 29 wherein said lever is pivoted on one side of said screw and said switch actuating end of said lever is disposed on an opposite side of said screw.

31. Apparatus as in claim 30 wherein said coupling means comprises a sleeve, said drive shaft and said screw being disposed in opposite ends of said sleeve, one of said drive shaft and said screw being connected to said sleeve against longitudinal movement with respect thereto and the other of said drive shaft and said screw being coupled in driving relation to said sleeve and movable longitudinally with respect thereto.

32. Apparatus as in claim 31 wherein said screw is connected to said sleeve and wherein said sleeve includes a longitudinal slot, and further including a transverse pin in said drive shaft, said pin disposed in said slot for rotating said sleeve and said sleeve being longitudinally movable with respect to said drive shaft.

33. Apparatus as in claim 32 including at least one annular groove in said sleeve transverse to and operatively communicating with said slot, whereby said pin moves into said groove and said drive shaft rotates without rotating said screw when said screw is moved longitudinally a distance greater than said predetermined distance in response to said door's striking an object to prevent motor overload.

34. Apparatus as in claim 33 including two pin receiving annular grooves one groove transverse to and operatively communicating with said slot at each respective end thereof.

35. In a screw-drive garage door operator having a motor with a drive shaft and a screw for driving a door between open and closed positions, said screw being in axial alignment with said drive shaft, and being movable in a longitudinal axial direction in response to said door's engagement with an obstruction, coupling means for coupling said drive shaft and said screw together for driving said screw, said coupling means comprising:

a sleeve, one end of said screw shaft disposed in one end of said sleeve and one end of said drive shaft disposed in another end of said sleeve, one of said drive shaft and said screw connected to said screw for rotation therewith, the other of said drive shaft and said screw having a pin, a longitudinal slot in said sleeve, and said pin disposed in said slot for rotation with said sleeve, said pin and sleeve being movable longitudinally with respect to each other when said screw moves in an axial direction, and at least one annular groove transverse to and operatively communicating with said slot, said pin moving through said slot and into said groove upon a predetermined longitudinal movement of said screw in response to engagement of said door with an obstruction, whereby rotation of said drive shaft continues without driving said screw.

* * * * *